United States Patent [19]

Breth et al.

[11] 3,946,874

[45] Mar. 30, 1976

[54] CORNER PAD

[75] Inventors: Ralph Gilbert Breth; James Robert Jenkins, both of Minneapolis; James Arthur Thole, St. Michael, all of Minn.

[73] Assignee: Federal Package Corporation, Minneapolis, Minn.

[22] Filed: Dec. 9, 1974

[21] Appl. No.: 530,589

[52] U.S. Cl. ..... 206/523; 206/813; 229/DIG. 1; 229/DIG. 9

[51] Int. Cl.[2] ..... B65D 81/04; B65D 85/30

[58] Field of Search ..... 206/523, 813; 229/14 C, 229/DIG. 1, DIG. 9

[56] References Cited

UNITED STATES PATENTS

| | | | |
|---|---|---|---|
| 3,314,584 | 4/1967 | Knapp et al. | 229/14 C |
| 3,334,798 | 8/1967 | Pezely, Jr. et al. | 206/523 X |
| 3,404,826 | 10/1968 | Carmody | 206/523 X |
| 3,404,827 | 10/1968 | Carmody | 229/14 C |
| 3,410,474 | 11/1968 | Keil | 229/14 C |
| 3,565,243 | 2/1971 | Freeman | 206/523 |
| 3,580,469 | 5/1971 | Reese | 206/523 X |
| 3,695,421 | 10/1972 | Wood | 206/523 |
| 3,854,650 | 12/1974 | Hanaue | 206/523 X |

*Primary Examiner*—Steven E. Lipman
*Attorney, Agent, or Firm*—Francis J. Bouda

[57] ABSTRACT

A one-piece, relatively thick, resilient corner pad which is used in the packaging of fragile articles. The pad is formed from three identical pieces of resilient material, and assembled so as to form a polyagonal, generally triangular, enrapment in the shape of a truncated, hollow triangular pyramid for the corner of a box or similar container, whereby, when the pad is placed over and around the meeting point of three sides of the container, the container will be spaced and resiliently held within a larger shipping container, without damage from high impact shocks. The unique design cuts costs since only four of such corner pads or cushions are needed — one each diagonally opposite another. The pads provide excellent dynamic cushioning under heavy static loads. The configuration of each of the three pieces is identical and so designed so that a minimum of raw material is utilized, with no significant waste when the pieces are cut from a sheet. The corner pads may be assembled at the factory into the truncated, hollow, triangular, pyramidal shape, or the individual pieces may be shipped in a more compact form to the customer who can quickly and easily assemble the corner pad on site.

10 Claims, 5 Drawing Figures

CORNER PAD

BACKGROUND OF THE INVENTION

The use of resilient packaging material and spacers is not new, as is clearly shown in Knapp U.S. Pat. No. 3,314,568 (Apr. 18, 1967) and Linnell U.S. Pat. No. 3,064,801 (Nov. 20, 1962). Such devices are designed so that less packaging material is used than the type of total enclosure shown in Smithers U.S. Pat. No. 2,860,768 (Nov. 18, 1958).

More importantly, the utilization of relatively thick, resilient packaging material, adapted to enclose only the corners of the package to be supported and protected, is more clearly shown in Reese U.S. Pat. No. 3,580,469 (May 25, 1971).

As is quite clear from the disclosures of the Reese and Knapp patents, it is highly desirable to fabricate the shock-absorbing devices from flat stock in such a manner as to utilize the maximum amount of material from the flat stock and to create the minimum amount of waste.

Thus the corner pad of the present invention (though being a unitary structure designed to enrap the corner of a package and separate the package, in three directions, from an enveloping outer shipping container) is constructed from three identical pieces of shock absorbing material such as polystyrene or foamed polyurethane. The distinguishing characteristic of the present invention is the utilization of a trio of absolutely identical portions assembled to form the three-sided, hollow triangular frusto-conical dynamic cushioning pad of the present invention.

SUMMARY OF THE INVENTION

It is an object of the present invention to provide the design for a corner pad used in packaging of fragile items contained in a generally rectangular carton, said pad formed of resilient or yieldable material, and constructed from three identically shaped, thick, foamed-plastic or rubber members, which, when assembled, provide a three-sided multi-dimensional hollow frusto-conical pad for enrapping the corner of a package containing fragile material.

The corner pad of the present invention may be assembled at the factory and shipped, ready for use, to the customer, or the individual items, three of which are later assembled to form a corner pad, may be shipped to the customer in a flatter, less space-consuming configuration, where the ultimate assembly may be performed by the customer.

DETAILED DESCRIPTION

For the purpose of illustrating the invention there is shown in the accompanying drawings a form thereof which is at present preferred, although it is to be understood that the various instrumentalities of which the invention consists can be variously arranged and organized and that the invention is not limited to the precise arrangement and organizations of the instrumentalities as herein shown and described.

In the drawings, wherein like reference characters indicate like parts,

Figure 2:
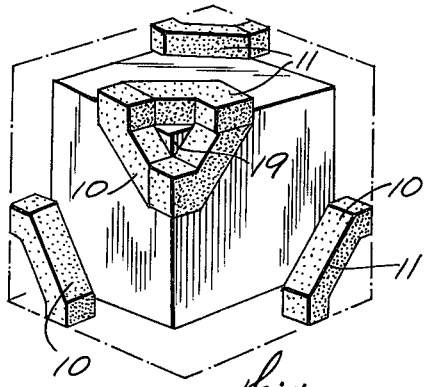
FIG. 2 represents a perspective view of a fragile container supported by four of the corner pads of the present invention, within an outer protective shipping container.

In the present invention, the corner pad 10, as shown in FIG. 2, is intended to enwrap three sides, at the corner, of a generally rectangular container for fragile items. The pad is so constructed and arranged that four of the pads can be utilized and disposed on the container at diagonally opposite corners, completely to support, from all directions, the inner container.

The corner pad 10 is constructed of three units or elements 11 which have a thickness or spacing dimension 12 appropriate to the shock absorbing and load bearing characteristics of the material and to the selectable space desired between the inner container and outer shipping box. This thickness or dimension 12 is chosen in advance by the manufacturer of the corner pad and may thus vary in relation to the inherent dynamic and static load bearing characteristics of the material being used.

Figure 5:
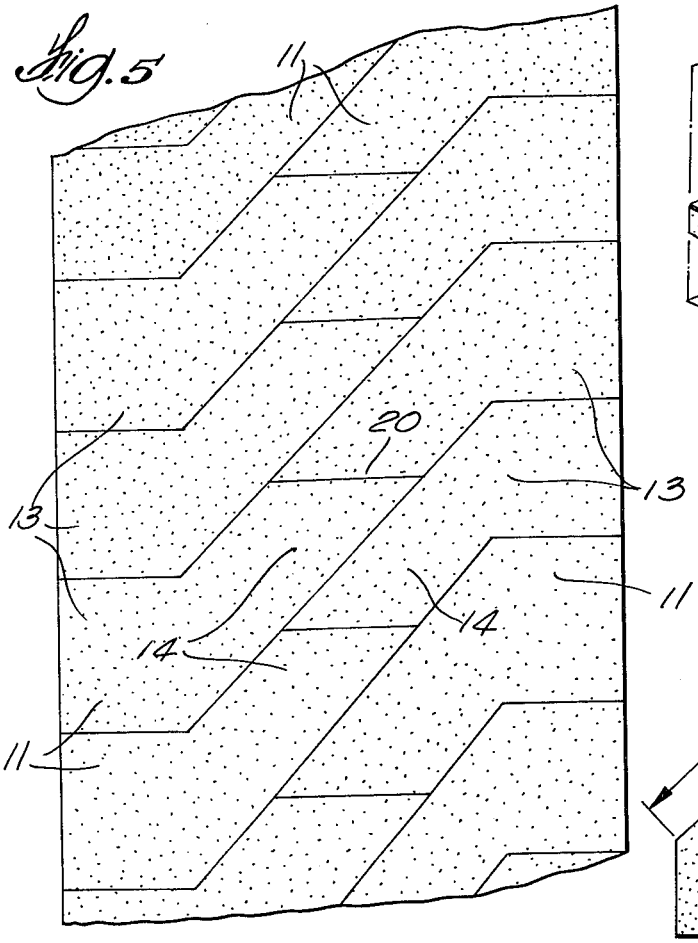
FIG. 5 is a top plan view of a sheet of resilient material with a plurality of the corner-pad elements laid out thereon, showing the arrangement of the material and the elements so as to use almost all the raw material.

The elements 11 are shaped in a generally angular configuration having a base 13 and an arm 14, and are so designed that, as shown in FIG. 5, a plurality of such units, properly laid out on a sheet of raw material, will use almost all of the raw material.

Figure 4:
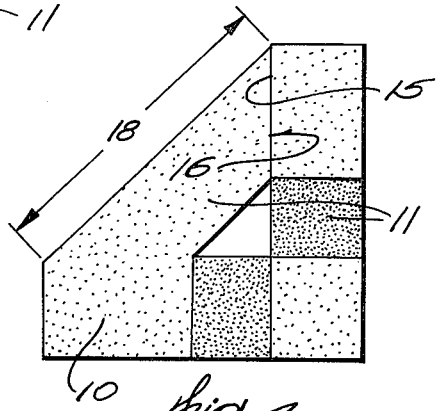
FIG. 4 is a side elevational view of one of the corner pads of the present invention.
Figure 1:
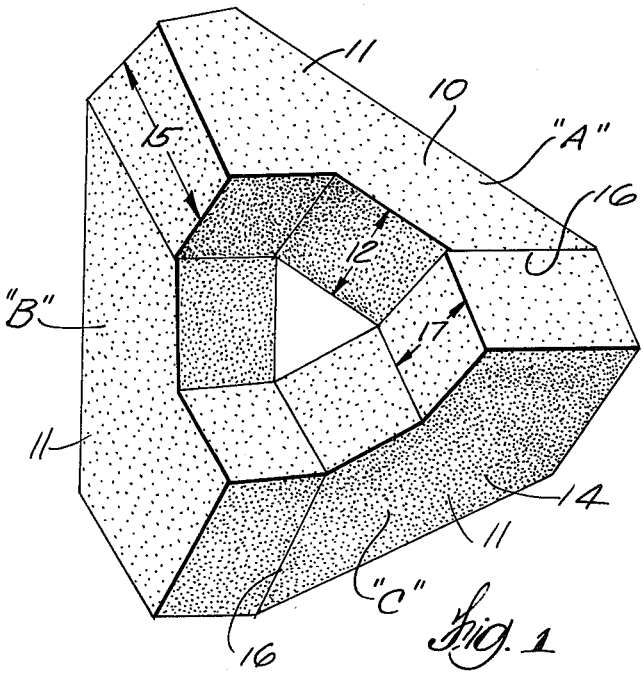
FIG. 1 represents a perspective view of the assembled corner pad of the present invention.
Figure 3:
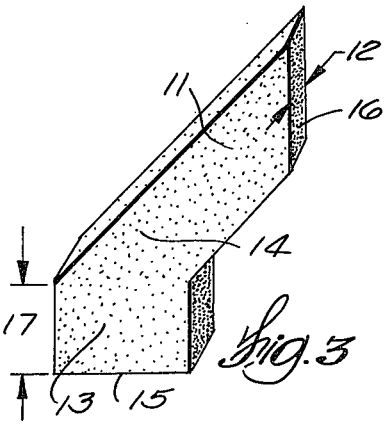
FIG. 3 represents a perspective view of one of the elements used in constructing the corner pad of the present invention.

The base 13 has a lower end 15, the length of which is identical to the length of the end 16 of the end of arm 14, thus, as shown particularly in FIG. 4, the two matching dimensions 15 and 16 mate properly when two of the elements are appropriately assembled, as shown in FIGS. 4 and 1.

In addition, the thickness 12 of the material determines the height 17 of the base 13 so that these dimensions 12 and 17 match appropriately during the assembly, as shown more particularly in FIG. 1.

The length 18 of the arm 14 may be chosen, as desired, to provide the opening through which the corner 19 of the package to be protected may extend, as shown in FIG. 2. However, the shorter the dimension 18, the smaller will be the opening and the less will be the protrusion of the corner 19 therethrough.

Similarly, the length 18 of the arm 14 must not be too long (relative to the thickness 12) so that the corner 19 will not be exposed unduly to shock or impact.

As is shown in FIG. 1, three of the elements 11 (here identified as "A," "B," and "C") are assembled so that the end 16 of each arm 14 is in contact with a face of an adjacent base portion 13 of an adjoining element. Thus the end 16 of the arm A is adjacent to the face of the base portion of element C, with the end of the arm of element C in contact with the face of the base portion 13 of the element B, and similarly the end of the arm 14 of element B is in contact with the face of the base portion 13 of the element A.

Thus it can be seen that the angle which the arm 14 makes with the base portion 13, and the corresponding angle of the end of the arm are appropriately chosen so that the end of each arm is flatly in contact with the face of the adjoining adjacent base portion 13.

Moreover, the angular disposition of the base and arm of each unit or element, with the corresponding angular disposition of the base and end of the arm, make it easy for the workmen to assemble the three elements into one corner pad merely by appropriately treating a face of the base portion and the end of the arm, and bringing the two elements into contact as is shown clearly in FIG. 1.

The unique characteristic of the corner pad of the present invention is the fact that the elements of which the corner pad are constructed are identical, and so designed that they can be cut or die-stamped from a flat continuous sheet of base material with substantially no waste of material. This is shown clearly in FIG. 5 where adjacent elements 11, are alternately and inversely disposed on the sheet so that the ends of the arms of adjacent elements are in contact with each other, as shown at 20, and with such pairs of elements repetitively disposed along the sheet of base material. This is particularly important as the price of such resilient material increases and the availability of the polymer or chemical material to form the base material becomes less and less.

It is also particularly important that the similarity of these elements provides the unique polygonal, hollow, frustoconical corner pad, without the need for complicated dies and designs, and without the requirement of having more than one shape for the elements combine to form the corner pads.

It is to be understood, however, that the present invention may be embodied in other specific forms without departing from the spirit or special attributes hereof, and it is therefore desired that the present embodiments be considered in all respects as illustrative and therefore not restrictive, reference being made to the appended claims rather than to the foregoing description to indicate the scope of the invention.

Having thus described the invention, what is claimed as new and desired to be protected by Letters Patent are the following:

1. A blank for use in fabricating a resilient corner pad comprising.

a sheet of yieldable material having a plurality of identical V-shaped units arranged thereon, each unit so designed and constructed so that substantially all of the sheet is utilized, said units each comprising a base and an arm with the arm disposed at an obtuse angle to the base, said base having a longitudinal dimension and said arm having a longitudinal dimension, the longitudinal dimension of the arm and the longitudinal dimension of the base being identical, said base having a transverse dimension and said arm having a thickness dimension, the transverse dimension of the base and the thickness dimension of the arm being identical.

2. The invention of claim 1 wherein the yieldable material is foamed polyurethane resilient polymer material.

3. The invention of claim 1 wherein the yieldable material is a natural cellular elastomer.

4. The unit of claim 1 formed of resilient vistro-elastic polymer material.

5. The unit of claim 1 formed of foamed styrene.

6. The invention of claim 1 wherein the yieldable material is styrene of high cellular structure.

7. A corner pad of hollow, frusto-conical, triangular, pyramidal configuration comprising three identical V-shaped elements formed of relatively thick, resilient material, each of said elements having a base and an arm at an obtuse angle thereto and a thickness, the end of each of said arms being flatly in contact with the face of the base of an adjacent element, all of said arms being disposed to form, with adjacent bases of elements in contact with faces of adjacent arms a continuous hollow, truncated, frusto-conical, triangular, pryamidal shock-absorbing member.

8. The corner pad of claim 7 wherein each of the three identical elements is formed of styrene.

9. The corner pad of claim 7 wherein each of the three identical elements is formed of a natural cellular elastomer.

10. The corner pad of claim 7 wherein each of the three identical elements is formed of vistro-elastic polymer material.

* * * * *